United States Patent [19]

Intraub

[11] Patent Number: 4,610,546

[45] Date of Patent: Sep. 9, 1986

[54] APPARATUS AND METHOD FOR SELF-RESONANT VIBRATIONAL MIXING

[75] Inventor: Julius Intraub, Plainview, N.Y.

[73] Assignee: Technicon Instruments Corporation, Tarrytown, N.Y.

[21] Appl. No.: 688,032

[22] Filed: Dec. 31, 1984

[51] Int. Cl.[4] ..... B01F 11/00

[52] U.S. Cl. ..... 366/110; 366/116

[58] Field of Search ..... 366/127, 110, 108, 111, 366/112, 116, 142, 114; 310/29, 30, 21, 22; 318/127

[56] References Cited

U.S. PATENT DOCUMENTS

| | | | |
|---|---|---|---|
| 2,549,179 | 4/1951 | Delaware | 366/127 |
| 3,472,493 | 10/1969 | Blank | 366/112 |
| 4,071,225 | 1/1978 | Holl | 366/127 |
| 4,479,098 | 10/1984 | Watson | 318/127 |

*Primary Examiner*—Robert W. Jenkins

*Attorney, Agent, or Firm*—Edward H. Gorman, Jr.; James R. Cartiglia; James J. Romano, Jr.

[57] ABSTRACT

New and improved, mechanically self-resonant apparatus and method for the non-invasive mixing of materials are disclosed, and comprise vibrator means including container means for the materials to be mixed, and drive means to drivingly vibrate the vibrator means. Sensor means are operatively associated with the vibrator means and the drive means, and are operable to sense the frequency of vibration of the vibrator means and maintain that frequency at or near the resonant frequency of the vibrator means. This promotes thorough mixing of the materials, and minimizes the energy input required for vibrational mixing of the materials. Control means are provided to control the amplitude of vibration of the vibrator means at or near the resonant frequency to avoid damage to the materials attendant mixing. The container means may take the form of a conduit through which the materials to be mixed are flowing attendant vibrational mixing.

16 Claims, 5 Drawing Figures

APPARATUS AND METHOD FOR SELF-RESONANT VIBRATIONAL MIXING

BACKGROUND OF THE INVENTION

1. Field of the Invention.

This invention relates to apparatus and method for the particularly thorough, non-invasive mixing of materials through vibration of the means in which said materials are contained, or through which said materials are flowing. More specifically, the invention relates to such apparatus and method as are particularly suitable for the mixing of fluid samples and reagents therefor in automated fluid sample analysis systems wherein the sample-reagent container is a reaction vessel, or a conduit of a continuous flow, automated fluid analysis system through which the sample and reagent are flowing.

2. Description of the Prior Art.

A wide variety of non-invasive mixing apparatus and methods are known in the prior art. These include static mixing appatatus and methods such as embodied by mixing coils or the like as commonly used in continuous flow sample analysis systems; and dynamic mixing apparatus and methods such as embodied in various agitator devices which vibrate, vortex or otherwise vigorously move a container for the purposes of mixing the materials contained therein. Non-invasive mixing apparatus and methods, of course, have the advantage of not introducing mixing blades or like mechanical devices into direct contact with the materials to be mixed, thereby avoiding potential contamination of those materials by the blades, and/or from one material to another.

More specifically, U.S. Pat. No. 3,844,067 to Borg discloses a magnetic vibrator for emulsifying milk in distilled water in patent FIG. 3. Magnetic vibrator 25 comprises magnetic coil 26, spring member 28 and armature 27. Tube holder 30 is fixed to armature 27 and rigidly holds tube 31 in an upright position. When the vibrator coil 26 is energized, tube 31 is vibrated in response thereto and mixes fluids contained therein. This apparatus provides no means for modifying the frequency or amplitude of vibration in response to the mass of the fluids to be mixed. Thus, different volumes, and thus masses, of fluids to be mixed, will be mixed at different efficiencies.

U.S. Pat. No. 4,264,559 to Price discloses a mixing device for laboratory tests in which the contents of the mixing container 19 are vibrated by spring-like metal lengths 1*a* and 1*b* which are mounted on upright mount 3 of base 9. Coupling mass 16 and upright clamp prong 18 are clamped to the lengths 1*a* and 1*b*. After mixing container 19 has been clamped to prong 18, the metal lengths are plucked by hand to impart a pendulum-like vibration to the metal lengths and the clamped container for a brief mixing period. Thus, mixing is not continuous, and no means are provided to relate the frequency or amplitude of the applied vibrational energy to the mass of the liquids to be mixed.

U.S. Pat. No. 3,338,047 to Kueffer discloses a frequency regulator for tuning forks wherein the frequency of vibration of the tuning fork is adjusted by adjusting the magnetic flux in the air gaps between the tuning fork tines, and the ends of a magnetic coil used to drive the tuning fork through C-shaped magnets 11 and 12 which are mounted to the ends of the fork tines 13 and 14. The magnetic coil produces driving pulses in proper phase relationship to sustain the vibration of the tuning fork at a predetermined frequency, which is adjustable as above by changing the magnetic reluctance of the coil core, by shunting a part of the magnetic flux between the ends of the core, or by moving the core back and forth along its axis. This patent is directed strictly to a timepiece driving system, and is in no way related to vibrational mixing.

U.S. Pat. No. 3,421,309 to Bennett discloses a unitized tuning fork vibrator directed strictly to the drive of a timepiece; while U.S. Pat. No. 3,382,459 discloses an electromechanical resonator comprising a tuning fork which may be driven in either of the tuning fork or reed modes of vibration for use in relay, oscillator or filter applications, and having no disclosed application to vibrational mixing.

U.S. Pat. No. 3,159,384 to Davis discloses a generally conventional agitation mixer in which a test tube is supported and agitated for mixing the contents thereof; while U.S. Pat. No. 4,042,218 discloses a generally conventional vortex mixer wherein a cylinder is driven at its base in a circular motion at substantially constant angular velocity to mix the fluids in test tubes as inserted into the cylinder.

To summarize this description of the prior art, it will be noted that no prior art is known to applicant which automatically relates the frequency of vibrational mixing to the mass of the materials to be mixed, or which enables the holding of the amplitude of vibrational mixing at that frequency to a predetermined level, both of which combine to optimize mixing while minimizing the required energy input.

OBJECTS OF THE INVENTION

It is, accordingly, an object of this invention to provide new and improved apparatus and method for the particularly thorough, non-invasive mixing of materials.

Another object of the invention is the provision of apparatus and method as above which effect mixing of the materials by automatically vibrating the same at or near the resonant frequency of the apparatus in accordance with the mass of the materials to be mixed.

A further object of the invention is the provision of apparatus and method as above which enable the amplitude of vibrational mixing at or near the resonant frequency to be held to a predetermined level.

Another object of this invention is the provision of apparatus and method as above which operate to optimize mixing, while minimizing the required energy input.

Another object of this invention is the provision of apparatus and method as above which are particularly adapted to the mixing of liquid samples and reagents in continuous flow, automated sample analysis systems.

A further object of this invention is the provision of apparatus and method as above which are of relatively simple and straightforward configuration and manner of operation, and which require the use of only readily available components of known operational characteristics and proven dependability in the fabrication thereof.

SUMMARY OF THE INVENTION

Apparatus and method for the mechanically self-resonant, non-invasive vibrational mixing of materials are provided, and comprise vibrator means taking the general configuration of a tuning fork, and electrically operable driver means operatively associated with the tuning fork and operable to electro-magnetically vibrate the same. Container means, taking the form of a conventional cup or test tube-like container into which the materials to be vibrationally mixed are placed, or the form of a flow system conduit or the like through which the materials to be mixed are concomittantly flowing, are included in the vibrator means. Operational and control circuit means, including an amplifier, are operably connected to the driver means, and operate to energize the same with resultant vibration of the tuning fork and the materials container, and mixing of the materials. Sensor means are operatively associated with the tuning fork and are operable to sense the frequency of vibration thereof and generate output signals in accordance therewith. These output signals are applied as positive feedback to the amplifier and operate to maintain the frequency of vibration of the vibrator means at or near the resonant frequency thereof despite change in the mass of the materials being mixed. This promotes thorough mixing of the materials, and minimizes the energy requirements of the apparatus. Gain control means are included in the amplifier, and operate to enable control of the amplitude of vibrational mixing.

DESCRIPTION OF THE DRAWINGS

The above and other objects and significant advantages of my invention are believed made clear by the following detailed description thereof taken in conjunction with the accompanying drawings wherein.

DETAILED DESCRIPTION OF THE INVENTION

Figure 1:
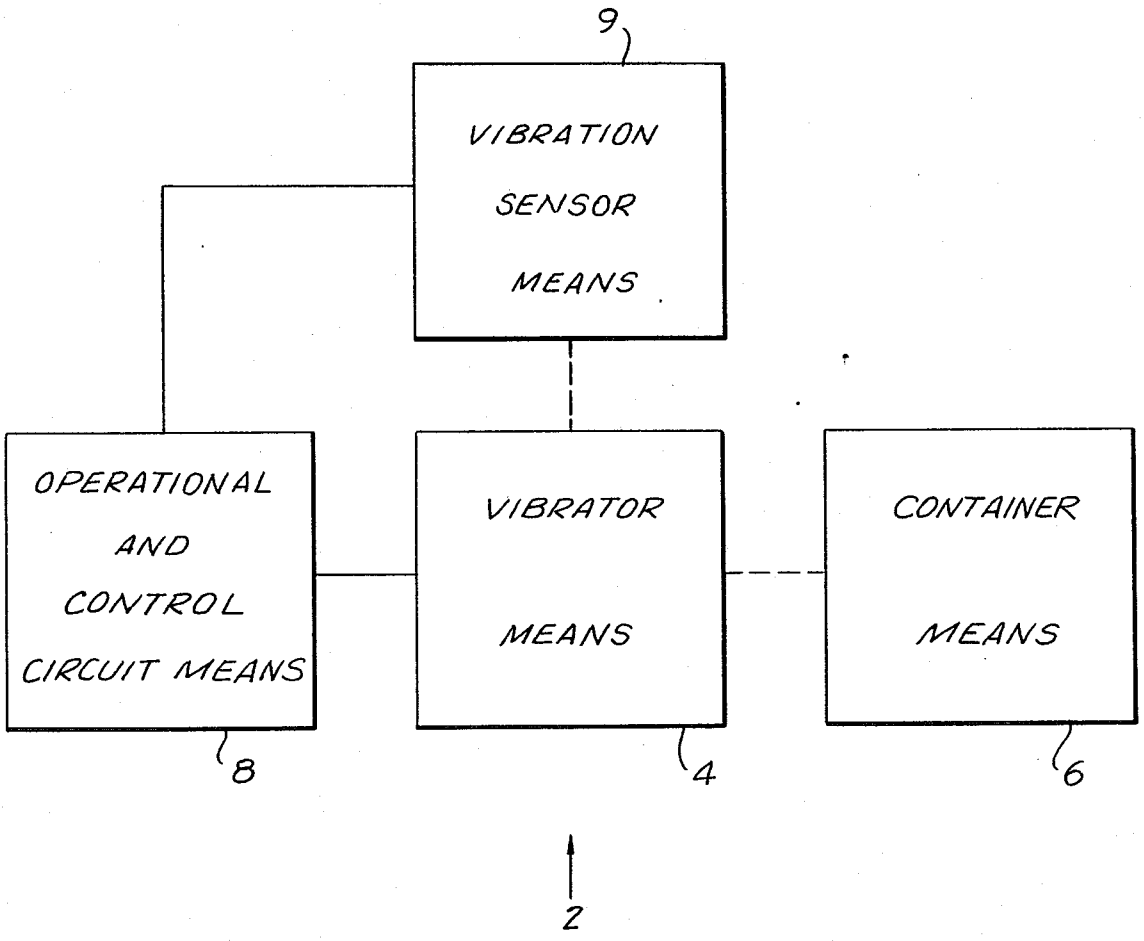
FIG. 1 is a block diagram of mechanically self-resonant, non-invasive vibrational mixing apparatus configured and operable in accordance with the teachings of my invention.

Referring now to the block diagram of FIG. 1, mechanically self-resonant, non-invasive vibrational mixing apparatus configured and operable in accordance with the teachings of my invention are indicated generally at 2; and comprise vibrator means 4 including container means 6 mechanically connected as indicated thereto for the containemnt of the materials to be mixed, operational and control circuit means 8 which are electrically connected as indicated to the vibrator means 4, and vibration sensor means 9 which are respectively mechanically and electrically connected as indicated to the vibrator means 4 and the operational and control circuit means 8. In operation as briefly described for introductory purposes, it may be understood that the vibrator means 4 are energized by the circuit means 8 to vibrate the container means 6 and mix the contents thereof. Concomittantly, the vibration sensor means 9, which may take the form of a piezoelectrically, electromechanically, photoelectrically or capacitively actuated transducer, are operable to sense the frequency of vibration of the vibrator means 4 and container means 6, and generate electrical signals in accordance therewith for application as positive feedback to the circuit means 8 to automatically adjust the frequency of vibration of the vibrator means 4 and the container means 6 to a frequency at or near the resonant frequency thereof. In addition, means are provided in the operational and control circuit means to enable the holding of the amplitude of vibration at or near the resonant frequency to a predetermined level.

Figure 2:
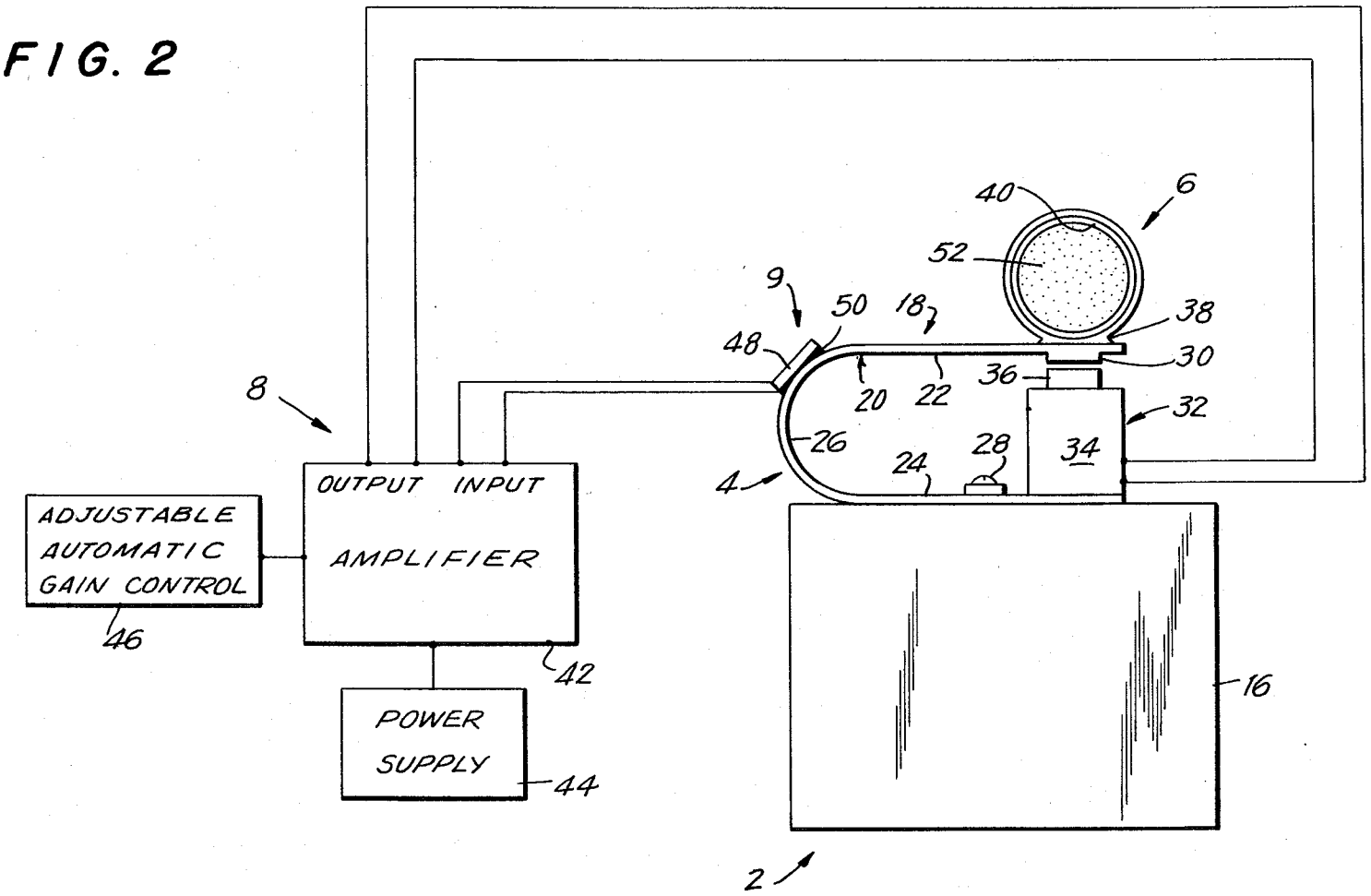
FIG. 2 is a partially schematic top plan view of a first embodiment of the apparatus of FIG. 1.

Referring now to the embodiment of FIG. 2, the vibrator means 4 comprise an anchor block 16 of significant mass predetermined to minimize counter motion of the block upon operation of the vibrator means. To this effect, anchor block 16 may, for example, be constituted by a relatively massive block of iron. A vibrator is indicated at 18, and takes the form of a generally U-shaped spring 20 having the vibrational characteristics of a tuning fork. To this effect, the spring 20 includes generally elongate tines 22 and 24 which are joined as shown by a curved central section 26. Spring 20 is made from any material of suitable strength, vibrational, and magnetic characteristics, for example, steel.

Tine 24 of spring 20 is very securely attached to one side of anchor block 16 in any suitable manner, for example, by mounting screw and lock washer as indicated at 28. In addition, a layer of a suitable epoxy or like adhesive, not shown, may be interpoesed at the spring tine-anchor block interface to further strengthen the attachment therebetween; it being understood by those skilled in this art that relative movement between the thusly attached spring tine 24 and the anchor block 16 is preferably rendered virtually impossible.

Spring tine 22 includes a somewhat enlarged portion 30 formed as shown adjacent the tine end to function as an armature as and for purposes described in detail hereinbelow.

Further included in the vibrator means 4 are vibrator drive means 32 which take the form of a magnetic coil 34 including a pole piece 36 extending therefrom as shown to terminate just short of the armature formed by enlarged tine portion 30 and in general alignment therewith. Of course, the exact distance between the pole piece 36 and armature 30 with the vibrator means at rest is carefully predetermined in accordance with the operational characteristics of the magnetic coil 34 to rpevent pole piece-armature surface contact during operation while nonetheless maximizing the transfer of magnetic energy therebetween.

The magnetic coil 34 is securely mounted as shown on the relevant surface of spring tine 24 in any suitable manner, for example, by a layer of suitable epoxy or like adhesive, not shown, at the coil-tine interface.

A constiner mounting bracket is indicated at 38, and is very securely attached as shown to the side of spring tine 22 remote from armature 30 in any suitable manner, for example, by a layer of a suitable epoxy or like adhesive, not shown, at the mounting bracket-spring tine interface. Preferably, the mounting bracket 38 is positioned as close as possible to the end of the spring tine 22, thus insuring maximum excursion for the mounting bracket attendant system operation.

In the embodiment of FIG. 2, the container means 6 comprise comprise a cup or test tube-like container 40 which is sized relative to the mounting bracket 38 to fit snugly therewithin as shown for secure mechanicl connection of the container to the spring tine 22.

With the respective components of the vibrator means 4 configured and relatively connected as described, it will be clear to those skilled in this art that the unsecured portions of spring 20, namely central portion 26, tine 22 and the armature 30, and the mounting bracket 38 and container 40, respectively, will vibrate as an essentially unitary system upon the application of vibrational energy to the spring.

The operational and control circuit means 8 comprise amplifier, power supply and adjustable gain control as respectively schematically illustrated at 42, 44 and 46 in FIG. 2, and interconnected as shown. The amplifier output is applied as shown to the magnetic coil 34 to drive the same to vibrate spring 20 as and for the purposes described hereinbelow.

The vibration sensor means as schematically illustrated at 9 in FIG. 2 may take a number of different configurations; each of which is operable to sense the frequency of vibration of spring 20 and provide an output voltage in accordance therewith for application as positive feedback to the input of amplifier 42.

One such vibration sensor means configuration is the multi-layered piezoelectric sensor in the nature of the bimorph or "bender" as manufactured and marketed by Vernitron Piezoelectric Division of Vernitron Corporation, Bedford, Ohio. Such sensors function to provide an output voltage in accordance with the frequency at which the same are stressed, as by bending.

Another such vibration sensor means configuration is the photoelectric sensor in the nature of the "fotonic" sensor as manufactured and marketed by Mechanical Technology, Inc. of Latham, N.Y. Such sensors generally comprise a light source and a photo-diode, and paddle-like shadowing means interposed therebetween; and function to provide an output voltage in accordance with the frequency at which the light is shadowed.

Another such vibration sensor means configuration is the capacitive sensor in the nature of the displacement sensor as manufactured and marketed by Mechanical Technology, Inc. of Latham, N.Y. Such sensors generally comprise spaced capacitor plates; and function to provide an output voltage in accordance with the frequency of relative movement between those plates.

Another such vibration sensor means configuration is the electro-mechanical sensor in the nature of the reluctance pick-up sensor as manufactured and marketed by Digital Systems Division of Vedder-Root, Inc., Hartford, Conn. Such sensors generally comprise a pick-up coil with a magnetic core; and function to provide an output voltage in accordance with the frequency of movement of the core relative to the coil.

With the vibration sensor means 9 constituted by a bimorph as indicated at 48 in FIG. 2, the same is very securely mounted on the spring 20 at the curved central spring section 26 just before the juncture thereof with spring tine 22, thus providing for maximum bending of the bimorph, and maximum output signal strength, attendant spring vibration as should be obvious. Preferably, this mounting is accomplished by a layer of epoxy or like adhesive as indicated at 50 which additionally functions to fill in the spaces between the essentially straight surface of the bimorph and the curved surface of the spring section, thus retaining the bimorph essentially straight when the spring is at rest, or moving through its center position when vibrating, with attendant maximization of output signal accuracy.

In those instances wherein the vibration sensor means 9 are constituted by the photoelectric, capacitive or electromechanicl sensors as described hereinabove, the operative elements thereof would preferably be mounted, again for example by a suitable epoxy, on spring tine 22 to maximize in each instance the excursion of the operative element, namely the shadowing means, capacitor plate, or core, and accordingly the strength of the output signal.

The output signal from the bimorph 48 is applied as shown as positive feedback to the input of amplifier 42.

With the vibrational mixing apparatus 2 of my invention configured and operable as described with regard to FIG. 2, and with the materials to be mixed disposed within container 40 as indicated at 52, it will be clear that application of power to amplifier 42 will energize pole piece 36 of magnetic coil 34 to magnetically drive spring armature 30 and vibrate the spring; it being understood by those skilled this art that omnipresent molecular noise or the like will invariably be sufficient to commence spring vibration without outside assistance. Thus, and in very short order, the essentially unitary system as now constituted by the spring section 26, spring tine 22, mounting bracket 38, container 40 and the materials 52 to be mixed, will be vibrated at or near the natural or resonant frequency thereof with attendant maximum excursion of the container 40 and materials 52 and maximum mixing of the latter in accordance with the energy applied to the system. Vibration at or near that resonant frequency will be maintained in accordance with the output signals from bimorph 48 applied as positive feedback to the amplifier 42.

Change in mass of this essentially unitary vibrating system in accordance with change in mass of the materials 52 in container 40—for example materials may be removed therefrom or added thereto, or all of the materials may be removed and a "new" batch of materials placed therein—and the attendant initial change in the frequency of vibration of the system, will be sensed by the bimorph 40. This will result in change in the output signal applied to amplifier 42, with resultant automatic adjustment in the output signal applied therefrom to coil 34 to compensate for this change in mass, and vibration of the system at or near a new resonant frequency as determined by the changed mass. Thus, vibration and mixing of the materials 52 at or near the new resonant frequency of the vibrating system is automatically established to track the change in mass of those materials.

In addition, the incorporation of the adjustable automatic gain control makes possible the rapid and convenient adjustment in the amplitude of vibration at or near the resonant system frequency. More specifically, should visual observation of the materials 52 attendant the mixing thereof indicate that the amplitude of such mixing is, for example, too great and likely to damage the same, it becomes a simple matter to manually adjust the gain control to bring that amplitude down to a proper level, without change in the resonant, or near resonant, frequency of vibrational mixing.

Figure 3:
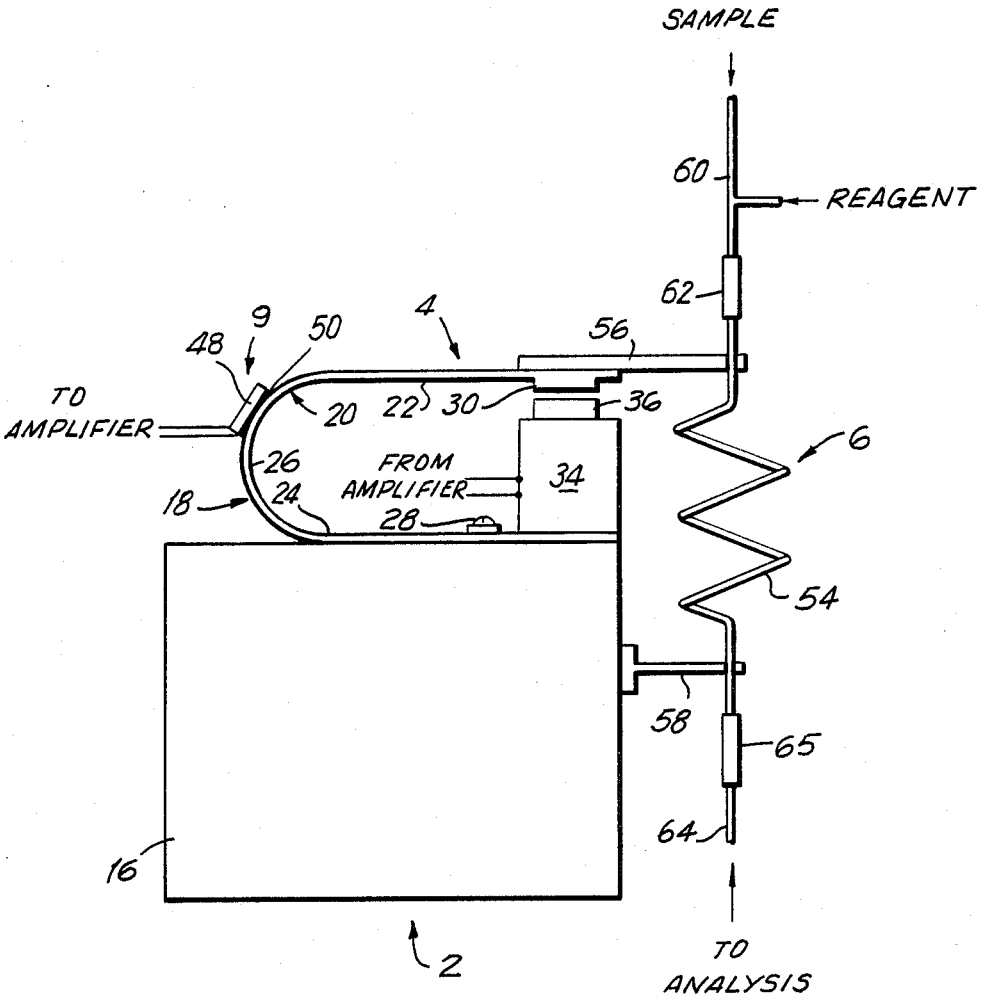
FIG. 3 is a top plan view of a second embodiment of the apparatus of FIG. 1.

The embodiment of FIG. 3 is essentially similar to the embodiment of FIG. 2, and like reference numerals are accordingly used to identify like components. In the embodiment of FIG. 3, however, the container means 6 are constituted by a mixing coil 54 which may, for example, constitute part of the flow path of continuous flow, automated sample analysis apparatus. The mixing coil 54, which may be of glass or plastic, is supported adjacent the respective coil ends by support brackets 56 and 58, respectively; with support bracket 56 preferably being made from a rigid material in the nature of steel, and support bracket 58 preferably being made from a resilient material in the nature of an appropriate plastic. Support bracket 56 is very securely attached to the outer surface of spring tine 22, again for example by a layer of suitable epoxy or like material, not shown;

while support bracket 58 is attached in like manner as shown to the side of anchor block 16.

For operation of the embodiment of FIG. 3, it will be clear that a T-shaped sample and reagent supply conduit 60 would be operatively connected as shown to the inlet side of mixing coil 54 by suitable vibration isolation connector means in the nature of a silicon rubber sleeve 62; while a conduit 64 to conduct the thoroughly mixed sample and reagent would be operatively connected to the outlet side of the coil in like manner by sleeve 65. Accordingly, and with discrete sample and reagent quantities flowing in turn through mixing coil 54, and with the vibrational mixing apparatus 2 of my invention operating as described to vibrate the coil and the sample and reagent quantities contained therein at every point in time at or near the resonant frequency of the system in accordance with the particular mass thereof at the particular point in time of interest, it will be clear to those skilled in this art that particularly thorough mixing of the samples and reagent in the mixing coil 54 will continuously occur, with the natural mixing action of the coil being very significantly enhanced by the vibration thereof.

Figure 4:
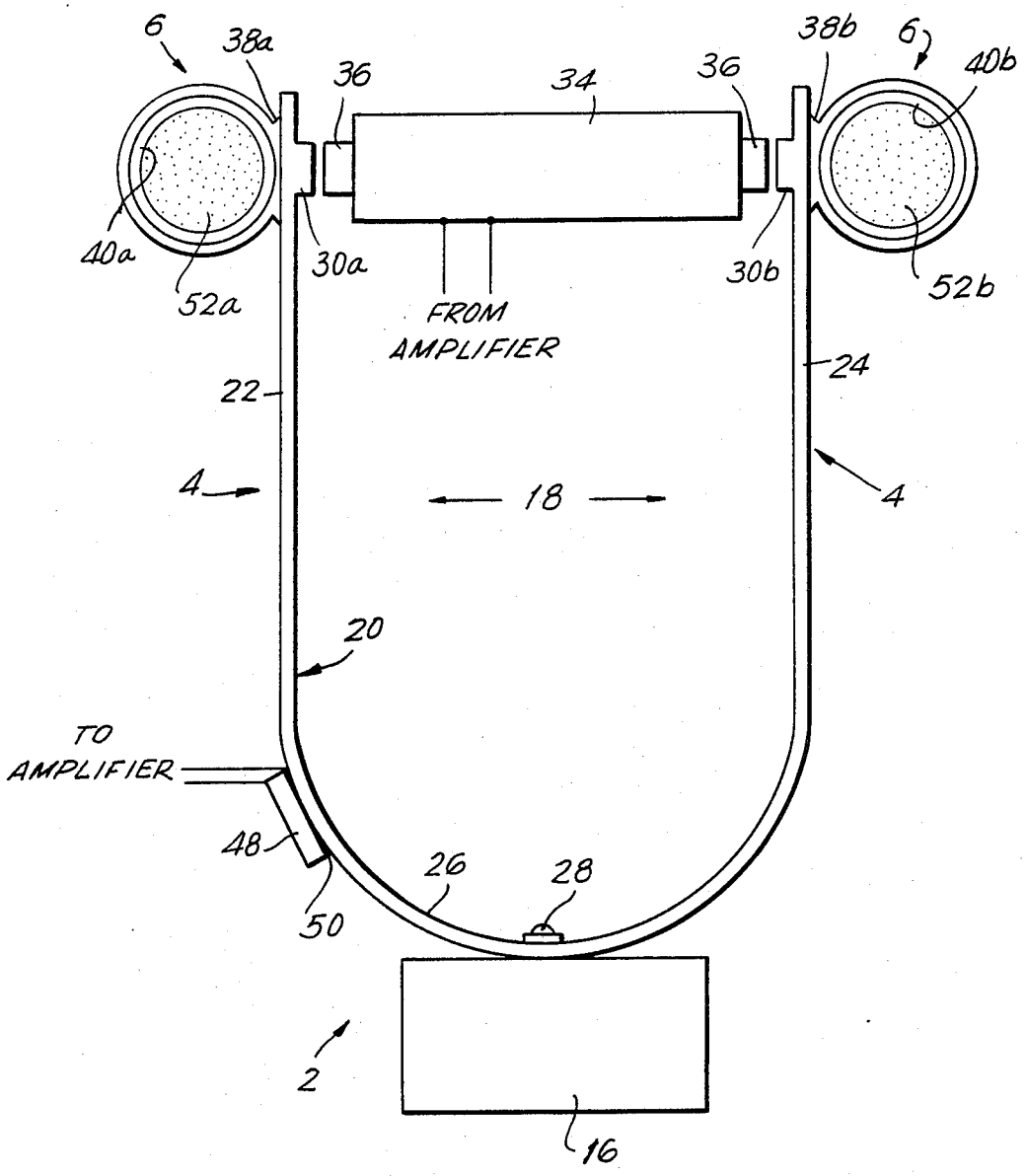
FIG. 4 is a top plan view of a third embodiment of the apparatus of FIG. 1.

The embodiment of FIG. 4 is again essentially similar to the embodiment of FIG. 2, and like reference numerals are again used to identify like components. In the embodiment of FIG. 4, however, the spring 20 is mounted as shown via the central spring section 26 rather than spring tine 24 on the mounting block 16 which, in view of the resultant generally symmetrical mounting of the spring 20 can be of substantially smaller mass as shown, while nonetheless continuing to minimize counter motion of the anchor block.

In the embodiment of FIG. 4, it will be seen that the magnetic pole piece 36 of coil 34 extends beyond both ends of the latter into operative relationship with armatures 30*a* and 30*b* which are formed as shown on the inner surfaces of each of the now essentially free-standing tines 22 and 24 of the spring 20. In addition, mounting brackets 38*a* and 38*b* are utilized, and are respectively secured as shown adjacent the respective ends of spring tines 22 and 24. Containers 40*a* and 40*b* are respectively disposed in and supported from the mounting brackets 38*a* and 38*b*; and respective quantities of materials, which may be of the same or slightly different masses, are disposed in containers 40*a* and 40*b* as indicated at 52*a* and 52*b*.

Operation of the embodiment of FIG. 4 remains essentially the same as operation of the embodiment of FIG. 2, with the same functioning to vibrate and mix the respective material quantities at or near the resonant frequency of the vibrating system; and the bimorph 48 functioning to continually provide output signals in accordance with the frequency of vibration of the system for application as positive feedback to amplifier 42 and return of the system to vibration at or near its resonant frequency in immediate response to change in mass of the material quantities 52*a* and/or 52*b*. Of course, with the arrangement of FIG. 4, the number of materials which can be mixed per unit of mixing time is doubled.

Figure 5:
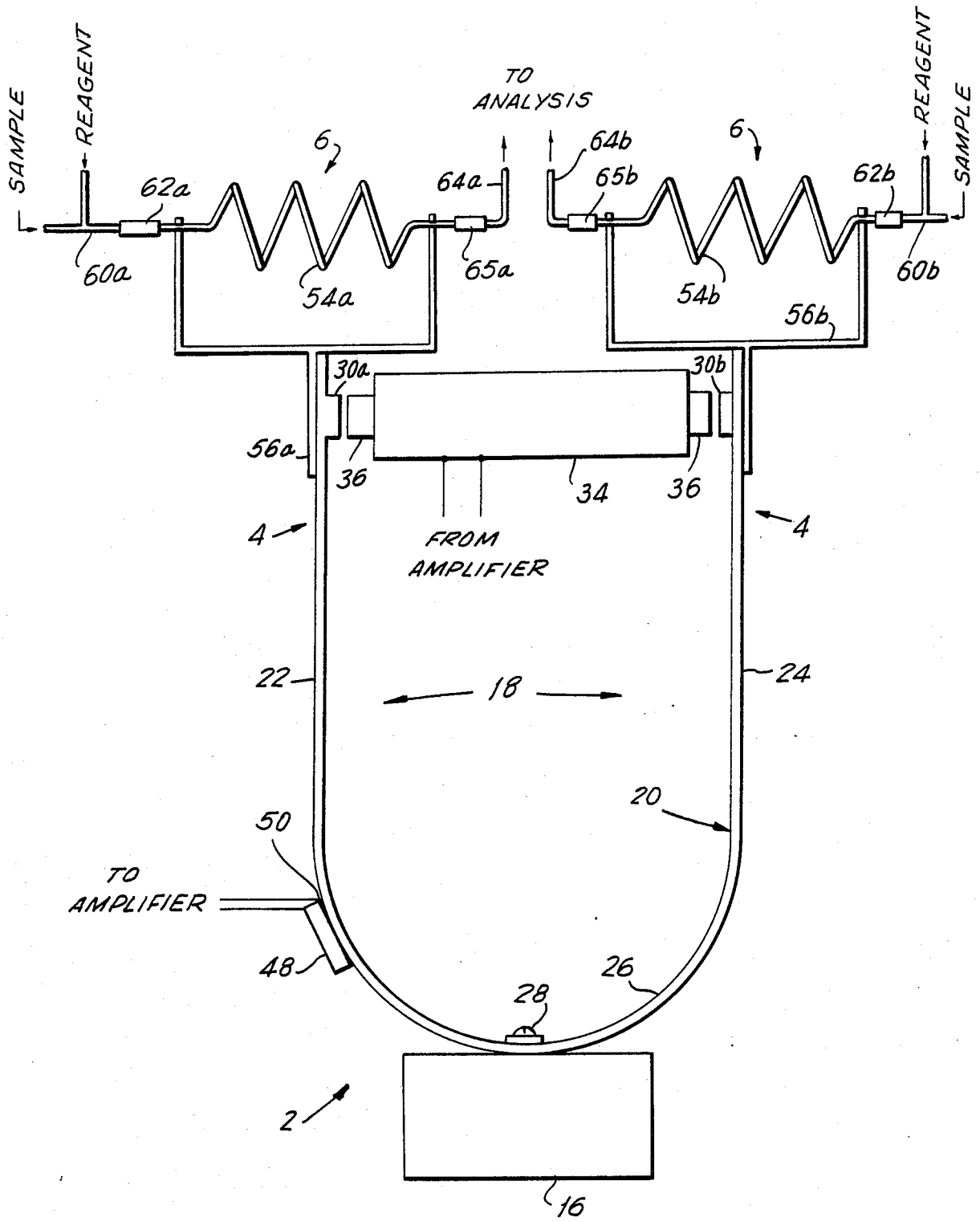
FIG. 5 is a top plan view of fourth embodiment of the apparatus of FIG. 1.

The embodiment of FIG. 5 is essentially similar to the embodiments of both FIGS. 3 and 4, and like reference numerals are again used to identify like components. In the embodiment of FIG. 5, however, each of the spring tines 22 and 24 is utilized to vibrate a separate mixing coil as indicated at 54*a* and 54*b*. To this effect, the support brackets 56*a* and 56*b* are each of the generally U-shaped configuration as shown, thereby enabling the independent support by each of the brackets of a separate mixing coil at spaced points adjacent, in each instance, the respective coil ends. The embodiment of FIG. 5 might, for example, find particular application in multi-channel, automated fluid sample anaysis apparatus of the nature disclosed, for example, in U.S. Pat. No. 3,241,432 to Leonard T. Skeggs, et al. In such instance, each of the mixing coils 54*a* and 54*b* could form part of a different analysis apparatus flow channel with different reagents being introduced to the liquid samples flowing through the respective mixing coils for automated analysis of the samples with regard to different sample constitutents.

Nothing set forth herein is intended to limit the nature, composition or number of materials which can be mixed by the apparatus of my invention; it being clear that the same are applicable to the mixing of any materials which are susceptible to such action by vibration.

Various changes may, of course, be made in the hereindisclosed embodiments of my invention without departing from the spirit and scope thereof as defined by the appended claims.

What is claimed is:

1. A self-resonant, non-invasive vibrational mixing apparatus for the mixing of materials comprising, vibrator means, container means for the materials to be mixed, means for mounting said container means on said vibrator means, driver means operatively associated with said vibrator means and operable to drivingly vibrate the same and said container means to mix the materials in said container means, control means operatively associated with said driver means and operable to control the frequency at which said driver means vibrate said vibrator means and said container means, and sensor means operatively associated with said vibrator means and said control means and operable to sense the frequency of said vibrator means and said container means and to operate said control means in response thereto to maintain the frequency of vibration of said vibrator means and said container means at or near the resonant frequency thereof whereby, said vibrator means and said container means will be vibrated at or near the resonant frequency thereof despite changes in the mass of materials in said container means.

2. Apparatus as in claim 1 wherein, said container means comprises a container into which said materials are placed for mixing.

3. Apparatus as in claim 2 wherein, said container means comprise a plurality of said containers.

4. Apparatus as in claim 1 wherein, said container means comprise a conduit through which said materials are flowing.

5. Apparatus as in claim 4 wherein, said container means comprise a plurality of said conduits.

6. Apparatus as in claim 1 wherein, said vibrator means comprise a spring.

7. Apparatus as in claim 6 wherein, said spring takes the form of a tuning fork.

8. Apparatus as in claim 7 wherein, said sensor means is a bimorph which is attached to said spring at an area of maximum vibrational bending of said spring.

9. Apparatus as in claim 7 wherein, said container means comprise a plurality of containers, at least one of which is attached to each tine of said spring.

10. Apparatus as in claim 1 wherein, said sensor means comprise a piezoelectric device.

11. Apparatus as in claim 1 wherein, said sensor means comprises a photoelectric device.

12. Apparatus as in claim 1 wherein, said sensor means comprise a capacitive device.

13. Apparatus as in claim 1 wherein, said sensor means comprise an electro-mechanical device.

14. Apparatus as in claim 1 wherein, said control means further comprise, means to control the amplitude at which the driver means vibrate the vibrator means.

15. Apparatus as in claim 1 wherein, said control means comprise an amplifier, and said sensor means are operable to generate an electrical signal in accordance with the frequency of vibration of said vibrator means and apply the same as a positive feedback signal to said amplifier.

16. Apparatus as in claim 1 wherein, said vibrator means comprise a magnetic material, said driver means comprise electromagnetic means operable to magnetically drive said magnetic material to vibrate said vibrator means, said control means comprise an amplifier, the output of which is applied to said electromagnetic means to operate the same, and said sensor means are operable to generate an electrical signal in accordance with the frequency of vibration of said vibrator means and apply the same as positive feedback to said amplifier to determine the amplifier output as applied to said electromagnetic means.

* * * * *